US010118220B2

(12) United States Patent
Thomas et al.

(10) Patent No.: US 10,118,220 B2
(45) Date of Patent: Nov. 6, 2018

(54) MOLD ASSEMBLIES USED FOR FABRICATING DOWNHOLE TOOLS

(71) Applicant: Halliburton Energy Services, Inc., Houston, TX (US)

(72) Inventors: Jeffrey G. Thomas, Magnolia, TX (US); Clayton Arthur Ownby, Houston, TX (US); Grant O. Cook, III, Spring, TX (US); Garrett T. Olsen, The Woodlands, TX (US); Daniel Brendan Voglewede, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 254 days.

(21) Appl. No.: 14/896,735

(22) PCT Filed: Dec. 2, 2014

(86) PCT No.: PCT/US2014/068035
§ 371 (c)(1),
(2) Date: Dec. 8, 2015

(87) PCT Pub. No.: WO2016/089365
PCT Pub. Date: Jun. 9, 2016

(65) Prior Publication Data

US 2016/0297002 A1 Oct. 13, 2016

(51) Int. Cl.
*B22C 9/06* (2006.01)
*B22D 27/04* (2006.01)
(Continued)

(52) U.S. Cl.
CPC ..... *B22D 27/045* (2013.01); *B22C 9/065* (2013.01); *B22F 3/02* (2013.01); *B22F 3/26* (2013.01);
(Continued)

(58) Field of Classification Search
CPC ..... B22C 9/065; B22D 27/045; B22D 19/06; B22D 19/14; B22D 23/06; B22D 25/02
(Continued)

(56) References Cited

U.S. PATENT DOCUMENTS 3,346,039 A * 10/1967 Lyons ..... B22D 27/04 164/122.1
4,033,401 A * 7/1977 Wlodawer ..... B22C 9/04 164/12
(Continued)

FOREIGN PATENT DOCUMENTS

JP H 06-304736 A 11/1994
JP H 11-28596 A 2/1999

OTHER PUBLICATIONS

International Preliminary Report on Patentability dated Jun. 15, 2017, from PCT/US2014/068035.
(Continued)

*Primary Examiner* — Kevin E Yoon
(74) *Attorney, Agent, or Firm* — Alan Bryson; Tumey L.L.P.

(57) ABSTRACT

An example mold assembly for fabricating an infiltrated downhole tool includes a mold forming a bottom of the mold assembly, and a funnel operatively coupled to the mold and having an inner wall, an outer wall, and a cavity defined between the inner and outer walls. An infiltration chamber is defined at least partially by the mold and the funnel. The inner wall faces the infiltration chamber and the outer wall forms at least a portion of an outer periphery of the mold assembly.

8 Claims, 8 Drawing Sheets

(51) Int. Cl.

| | |
|---|---|
| ***B22F 3/02*** | (2006.01) |
| ***B22F 3/26*** | (2006.01) |
| ***C22C 29/06*** | (2006.01) |
| *B22F 7/06* | (2006.01) |
| *B22F 5/00* | (2006.01) |

(52) U.S. Cl.
CPC ..... *C22C 29/06* (2013.01); *B22F 2005/001* (2013.01); *B22F 2007/066* (2013.01); *B22F 2203/11* (2013.01); *B22F 2999/00* (2013.01)

(58) Field of Classification Search
USPC ..... 164/338.1, 97, 98
See application file for complete search history.

(56) References Cited

U.S. PATENT DOCUMENTS

| | | | | |
|---|---|---|---|---|
| 5,275,227 | A | 1/1994 | Staub | |
| 5,373,907 | A * | 12/1994 | Weaver | C22C 1/1036 175/426 |
| 5,553,656 | A * | 9/1996 | Cook | B22D 27/045 164/120 |
| 6,932,145 | B2 | 8/2005 | Frasier et al. | |
| 7,343,960 | B1 | 3/2008 | Frasier et al. | |
| 7,377,305 | B2 | 5/2008 | Frasier et al. | |
| 7,398,840 | B2 * | 7/2008 | Ladi | B22D 19/06 175/374 |
| 7,418,993 | B2 | 9/2008 | Frasier et al. | |
| 7,779,890 | B2 | 8/2010 | Frasier et al. | |
| 7,824,494 | B2 | 11/2010 | Frasier et al. | |
| 8,047,260 | B2 | 11/2011 | Uno et al. | |
| 8,082,976 | B2 | 12/2011 | Frasier et al. | |
| 8,087,446 | B2 | 1/2012 | Frasier et al. | |
| 8,181,692 | B2 | 5/2012 | Frasier et al. | |
| 8,272,295 | B2 | 9/2012 | Smith et al. | |
| 8,550,144 | B2 | 10/2013 | Frasier et al. | |
| 2006/0213632 | A1 * | 9/2006 | Vogt | B22C 7/02 164/6 |
| 2008/0028891 | A1 | 2/2008 | Calnan et al. | |
| 2010/0101747 | A1 | 4/2010 | Tomczak et al. | |
| 2010/0212860 | A1 | 8/2010 | Rule | |
| 2011/0121475 | A1 | 5/2011 | Reese et al. | |
| 2011/0167734 | A1 | 7/2011 | Jiang et al. | |
| 2012/0298323 | A1 * | 11/2012 | Thomas | B22F 3/004 164/97 |
| 2013/0299671 | A1 * | 11/2013 | Zhu | B22D 7/064 249/111 |
| 2013/0313403 | A1 | 11/2013 | Atkins et al. | |
| 2013/0333950 | A1 | 12/2013 | Atkins et al. | |
| 2015/0343528 | A1 | 12/2015 | Atkins et al. | |

OTHER PUBLICATIONS

International Search Report and Written Opinion for PCT/US2014/068035 dated Aug. 24, 2015.

* cited by examiner

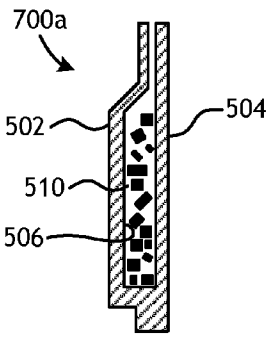
FIG. 7A
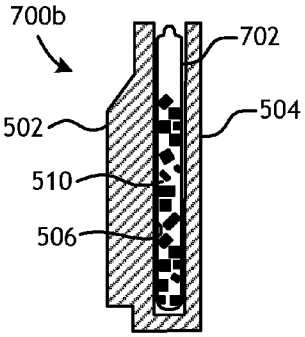
FIG. 7B
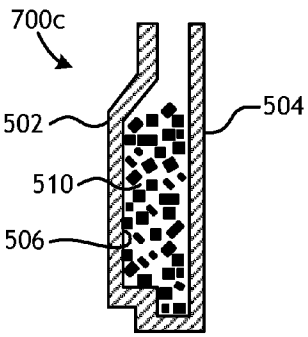
FIG. 7C
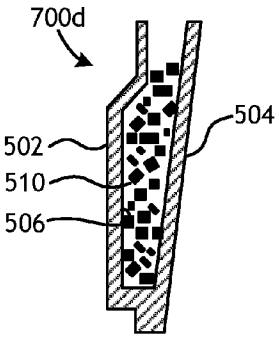
FIG. 7D
FIG. 8A
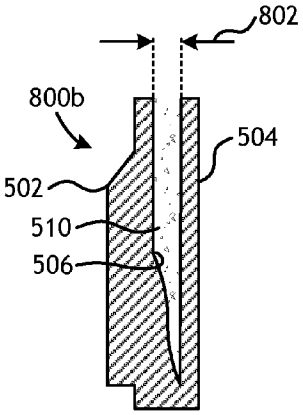
FIG. 8B
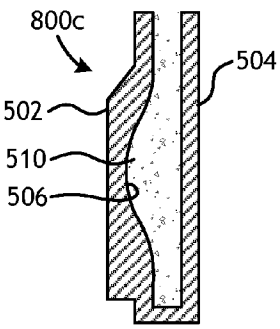
FIG. 8C
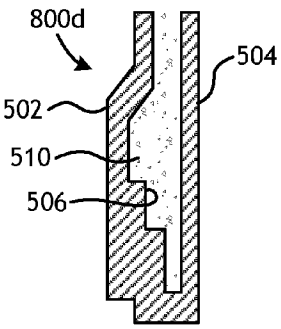
FIG. 8D
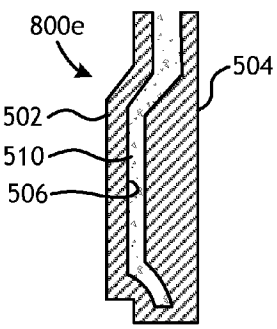
FIG. 8E

MOLD ASSEMBLIES USED FOR FABRICATING DOWNHOLE TOOLS

This application is a National Stage entry of and claims priority to International Application No. PCT/US2014/068035, filed on Dec. 2, 2014.

BACKGROUND

A variety of downhole tools are commonly used in the exploration and production of hydrocarbons. Examples of such downhole tools include cutting tools, such as drill bits, reamers, stabilizers, and coring bits; drilling tools, such as rotary steerable devices and mud motors; and other downhole tools, such as window mills, packers, tool joints, and other wear-prone tools. Rotary drill bits are often used to drill wellbores. One type of rotary drill bit is a fixed-cutter drill bit that has a bit body comprising matrix and reinforcement materials, i.e., a "matrix drill bit" as referred to herein. Matrix drill bits usually include cutting elements or inserts positioned at selected locations on the exterior of the matrix bit body. Fluid flow passageways are formed within the matrix bit body to allow communication of drilling fluids from associated surface drilling equipment through a drill string or drill pipe attached to the matrix bit body.

Matrix drill bits are typically manufactured by placing powder material into a mold and infiltrating the powder material with a binder material, such as a metallic alloy. The various features of the resulting matrix drill bit, such as blades, cutter pockets, and/or fluid-flow passageways, may be provided by shaping the mold cavity and/or by positioning temporary displacement materials within interior portions of the mold cavity. A preformed bit blank (or steel mandrel) may be placed within the mold cavity to provide reinforcement for the matrix bit body and to allow attachment of the resulting matrix drill bit with a drill string. A quantity of matrix reinforcement material (typically in powder form) may then be placed within the mold cavity with a quantity of the binder material.

The mold is then placed within a furnace and the temperature of the mold is increased to a desired temperature to allow the binder (e.g., metallic alloy) to liquefy and infiltrate the matrix reinforcement material. The furnace typically maintains this desired temperature to the point that the infiltration process is deemed complete, such as when a specific location in the bit reaches a certain temperature. Once the designated process time or temperature has been reached, the mold containing the infiltrated matrix bit is removed from the furnace. As the mold is removed from the furnace, the mold begins to rapidly lose heat to its surrounding environment via heat transfer, such as radiation and/or convection in all directions.

This heat loss continues to a large extent until the mold is moved and placed on a cooling plate and an insulation enclosure or "hot hat" is lowered around the mold. The insulation enclosure drastically reduces the rate of heat loss from the top and sides of the mold while heat is drawn from the bottom of the mold through the cooling plate. This controlled cooling of the mold and the infiltrated matrix bit contained therein can facilitate axial solidification dominating radial solidification, which is loosely termed directional solidification.

As the molten material of the infiltrated matrix bit cools, there is a tendency for shrinkage that could result in voids forming within the bit body unless the molten material is able to continuously backfill such voids. In some cases, for instance, one or more intermediate regions within the bit body may solidify prior to adjacent regions and thereby stop the flow of molten material to locations where shrinkage porosity is developing. For instance, cooling can create stresses at the interface between the metal blank and the molten material. These stresses can cause cracking as the molten material begins to solidify. In other cases, shrinkage porosity may result in poor metallurgical bonding at the interface between the bit blank and the molten materials, which can also result in the formation of cracks within the bit body that can be difficult or impossible to inspect. When such bonding defects are present and/or detected, the drill bit is often scrapped during or following manufacturing assuming they cannot be remedied. Every effort is made to detect these defects and reject any defective drill bit components during manufacturing to help ensure that the drill bits used in a job at a well site will not prematurely fail and to minimize any risk of possible damage to the well.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

FIGS. 7A-7D are partial cross-sectional side views of other exemplary funnels that may be used in the mold assembly of FIG. 3.

FIGS. 8A-8E are partial cross-sectional side views of other exemplary funnels that may be used in the mold assembly of FIG. 3.

DETAILED DESCRIPTION

The present disclosure relates to tool manufacturing and, more particularly, to mold configurations for downhole tools that help control the thermal profile of the downhole tools during manufacture.

The embodiments described herein improve directional solidification of infiltrated downhole tools by introducing alternative designs to standard mold assembly components used during the infiltration process to thereby achieve a desired thermal profile. According to the present disclosure, the mold assembly may include at least a mold that forms a bottom of the mold assembly, and a funnel that is operatively coupled to the mold. The funnel has an inner wall, an outer wall, and a cavity defined between the inner and outer walls. In some embodiments, a thermal material may be positioned within the cavity to help influence the overall thermal profile of the mold assembly and facilitate directional cooling of the molten contents within the mold assembly. Depending on the material selected, the thermal material can serve as an insulator, a heat sink, or a thermal energy source in controlling the cooling process of the infiltrated downhole tool. Among other things, this may improve quality and reduce the rejection rate of drill bit components due to defects during manufacturing.

Figure 1:
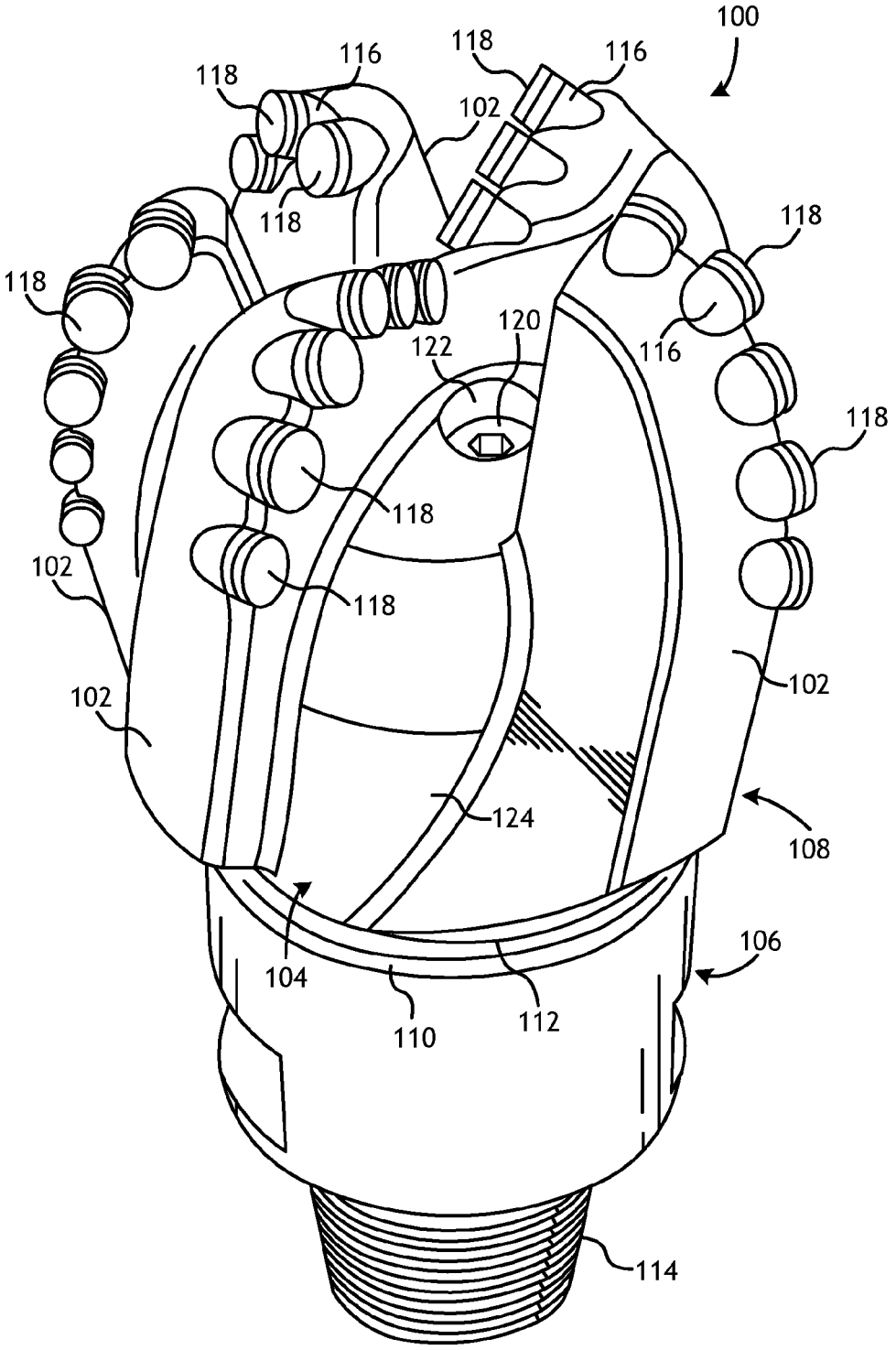
FIG. 1 is a perspective view of an exemplary fixed-cutter drill bit that may be fabricated in accordance with the principles of the present disclosure.

FIG. 1 illustrates a perspective view of an example fixed-cutter drill bit 100 that may be fabricated in accordance with the principles of the present disclosure. It should be noted that, while FIG. 1 depicts a fixed-cutter drill bit 100, the principles of the present disclosure are equally applicable to any type of downhole tool that may be formed or otherwise manufactured through an infiltration process. For example, suitable infiltrated downhole tools that may be manufactured in accordance with the present disclosure include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters, cutting elements), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, washover tools, rotors, stators and/or housings for downhole drilling motors, blades and housings for downhole turbines, and other downhole tools having complex configurations and/or asymmetric geometries associated with forming a wellbore.

As illustrated in FIG. 1, the fixed-cutter drill bit 100 (hereafter "the drill bit 100") may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple recesses or pockets 116 are formed. Cutting elements 118 may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each adjacent pair of cutter blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

Figure 2:
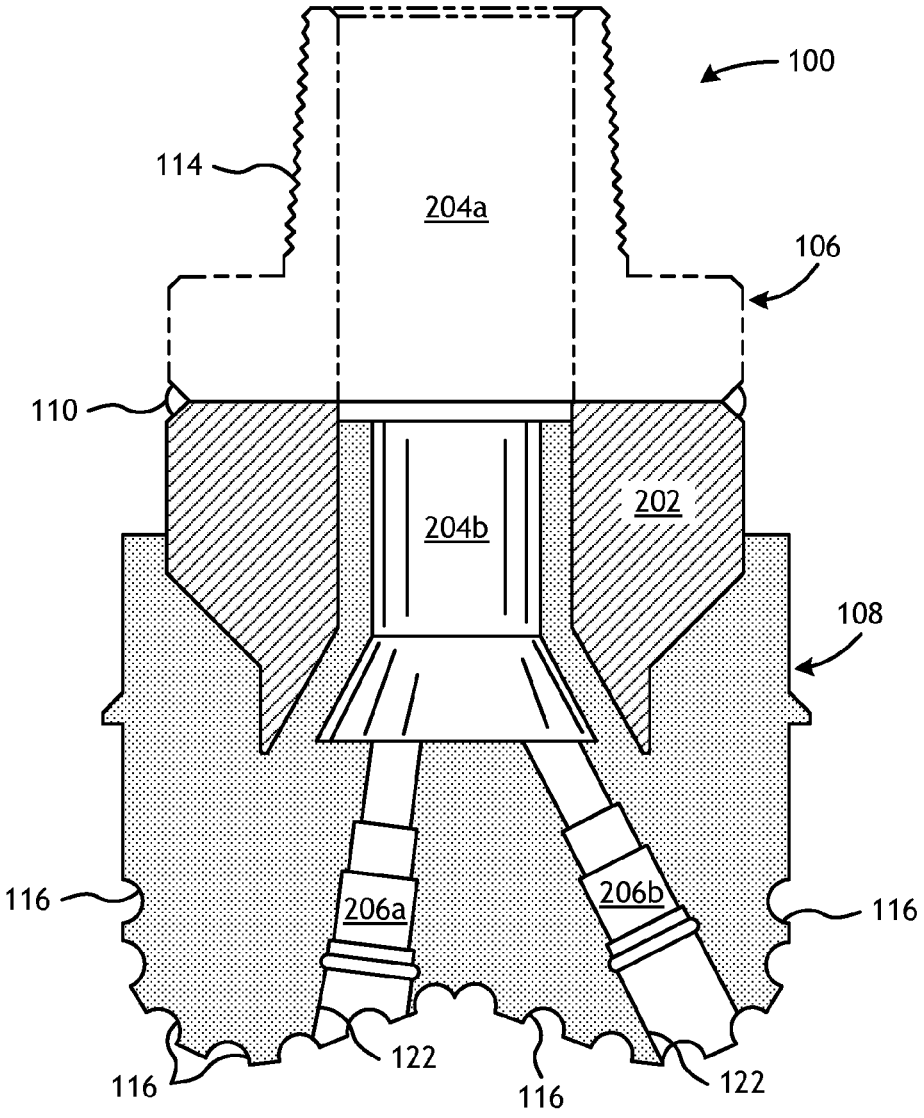
FIG. 2 is a cross-sectional view of the drill bit of FIG. 1.

FIG. 2 is a cross-sectional side view of the drill bit 100 of FIG. 1. Similar numerals from FIG. 1 that are used in FIG. 2 refer to similar components that are not described again. As illustrated, the shank 106 may be securely attached to a metal blank (or mandrel) 202 at the weld 110 and the metal blank 202 extends into the bit body 108. The shank 106 and the metal blank 202 are generally cylindrical structures that define corresponding fluid cavities 204*a* and 204*b*, respectively, in fluid communication with each other. The fluid cavity 204*b* of the metal blank 202 may further extend longitudinally into the bit body 108. At least one flow passageway (shown as two flow passageways 206*a* and 206*b*) may extend from the fluid cavity 204*b* to exterior portions of the bit body 108. The nozzle openings 122 may be defined at the ends of the flow passageways 206*a* and 206*b* at the exterior portions of the bit body 108. The pockets 116 are formed in the bit body 108 and are shaped or otherwise configured to receive the cutting elements 118 (FIG. 1).

Figure 3:
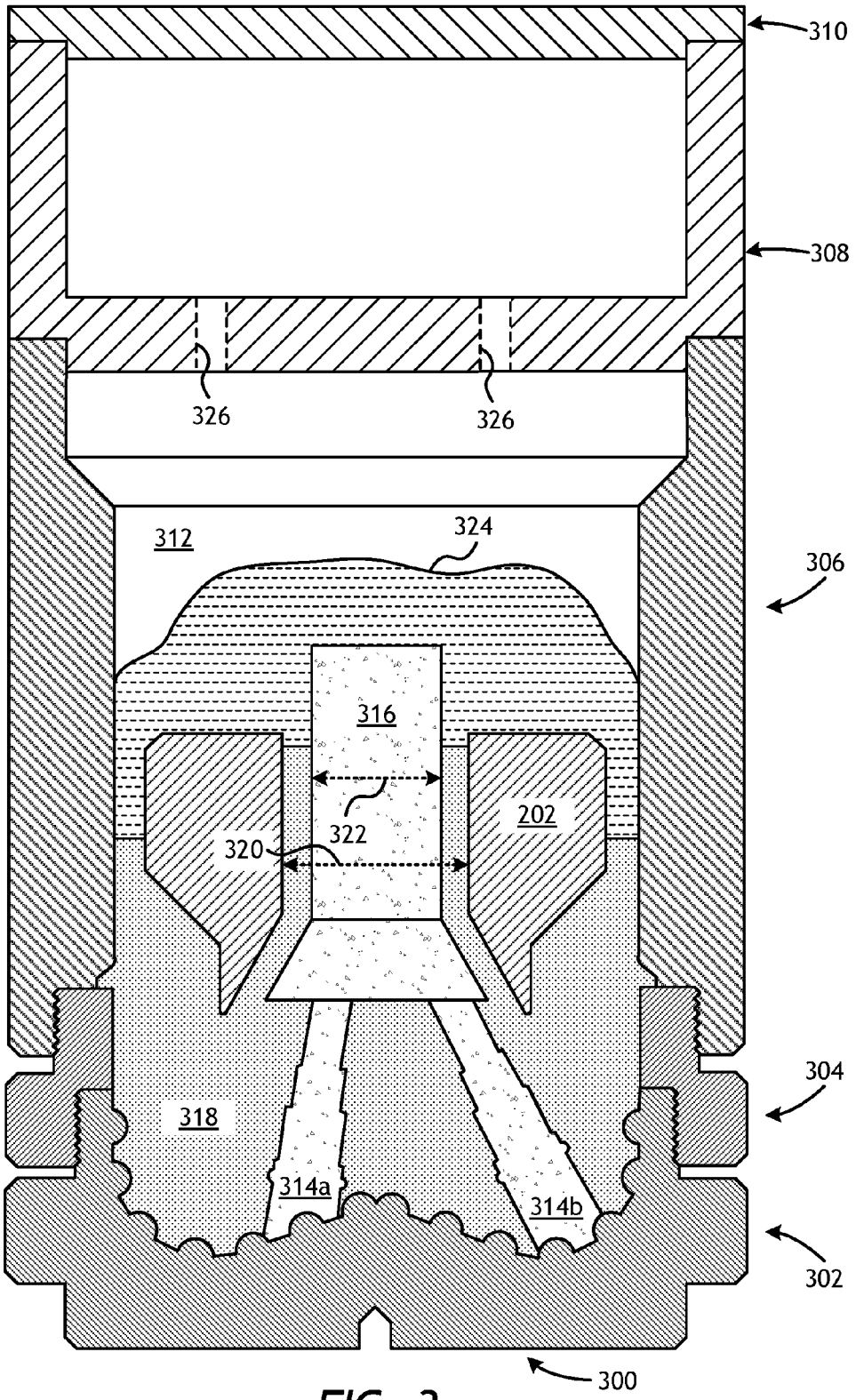
FIG. 3 is a cross-sectional side view of an exemplary mold assembly for use in forming the drill bit of FIG. 1.

FIG. 3 is a cross-sectional side view of a mold assembly 300 that may be used to form the drill bit 100 of FIGS. 1 and 2. While the mold assembly 300 is shown and discussed as being used to help fabricate the drill bit 100, those skilled in the art will readily appreciate that mold assembly 300 and its several variations described herein may be used to help fabricate any of the infiltrated downhole tools mentioned above, without departing from the scope of the disclosure. As illustrated, the mold assembly 300 may include several components such as a mold 302, a gauge ring 304, and a funnel 306. In some embodiments, the funnel 306 may be operatively coupled to the mold 302 via the gauge ring 304, such as by corresponding threaded engagements, as illustrated. In other embodiments, the gauge ring 304 may be omitted from the mold assembly 300 and the funnel 306 may instead be operatively coupled directly to the mold 302, such as via a corresponding threaded engagement, without departing from the scope of the disclosure.

In some embodiments, as illustrated, the mold assembly 300 may further include a binder bowl 308 and a cap 310 placed above the funnel 306. The mold 302, the gauge ring 304, the funnel 306, the binder bowl 308, and the cap 310 may each be made of or otherwise comprise graphite or alumina ($Al_2O_3$), for example, or other suitable materials. An infiltration chamber 312 may be defined or otherwise provided within the mold assembly 300. Various techniques may be used to manufacture the mold assembly 300 and its components including, but not limited to, machining graphite blanks to produce the various components and thereby define the infiltration chamber 312 to exhibit a negative or reverse profile of desired exterior features of the drill bit 100 (FIGS. 1 and 2).

Materials, such as consolidated sand or graphite, may be positioned within the mold assembly 300 at desired locations to form various features of the drill bit 100 (FIGS. 1 and 2). For example, consolidated sand legs 314*a* and 314*b* may be positioned to correspond with desired locations and configurations of the flow passageways 206*a,b* (FIG. 2) and their respective nozzle openings 122 (FIGS. 1 and 2). Moreover, a cylindrically-shaped consolidated sand core 316 may be placed on the legs 314*a,b*. The number of legs 314*a,b* extending from the sand core 316 will depend upon the desired number of flow passageways and corresponding nozzle openings 122 in the drill bit 100.

After the desired materials, including the sand core 316 and the legs 314*a,b,* have been installed within the mold assembly 300, matrix reinforcement materials 318 may then be placed within or otherwise introduced into the mold assembly 300. For some applications, two or more different types of matrix reinforcement materials 318 may be deposited in the mold assembly 300. Suitable matrix reinforcement materials 318 include, but are not limited to, tungsten carbide, monotungsten carbide (WC), ditungsten carbide ($W_2C$), macrocrystalline tungsten carbide, other metal carbides, metal borides, metal oxides, metal nitrides, natural and synthetic diamond, and polycrystalline diamond (PCD). Examples of other metal carbides may include, but are not limited to, titanium carbide and tantalum carbide, and various mixtures of such materials may also be used.

The metal blank 202 may be supported at least partially by the matrix reinforcement materials 318 within the infiltration chamber 312. More particularly, after a sufficient volume of the matrix reinforcement materials 318 has been added to the mold assembly 300, the metal blank 202 may then be placed within mold assembly 300. The metal blank 202 may include an inside diameter 320 that is greater than an outside diameter 322 of the sand core 316, and various fixtures (not expressly shown) may be used to position the metal blank 202 within the mold assembly 300 at a desired location. The matrix reinforcement materials 318 may then be filled to a desired level within the infiltration chamber 312.

Binder material 324 may then be placed on top of the matrix reinforcement materials 318, the metal blank 202, and the core 316. Various types of binder materials 324 may be used and include, but are not limited to, metallic alloys of copper (Cu), nickel (Ni), manganese (Mn), lead (Pb), zinc (Zn), tin (Sn), cobalt (Co) and silver (Ag). Phosphorous (P) may sometimes also be added in small quantities to reduce the melting temperature range of infiltration materials positioned in the mold assembly 300. Various mixtures of such metallic alloys may also be used as the binder material 324. In some embodiments, the binder material 324 may be covered with a flux layer (not expressly shown). The amount of binder material 324 and optional flux material added to the infiltration chamber 312 should be at least enough to infiltrate the matrix reinforcement materials 318 during the infiltration process. In some instances, some or all of the binder material 324 may be placed in the binder bowl 308, which may be used to distribute the binder material 324 into the infiltration chamber 312 via various conduits 326 that extend therethrough. The cap 310 (if used) may then be placed over the mold assembly 300, thereby readying the mold assembly 300 for heating.

Figure 4A:
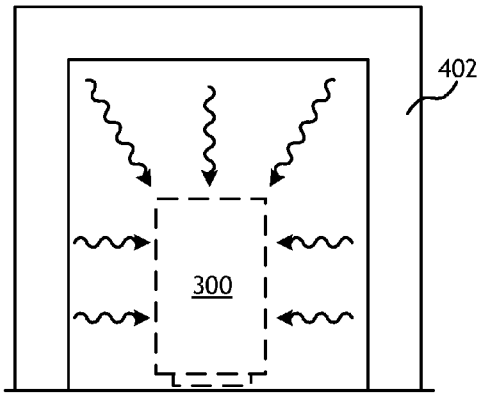
FIGS. 4A-4C are progressive schematic diagrams of an exemplary method of fabricating a drill bit.
Figure 4B:
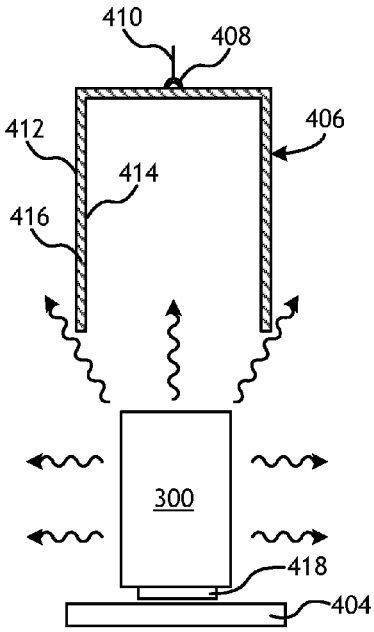
Figure 4C:
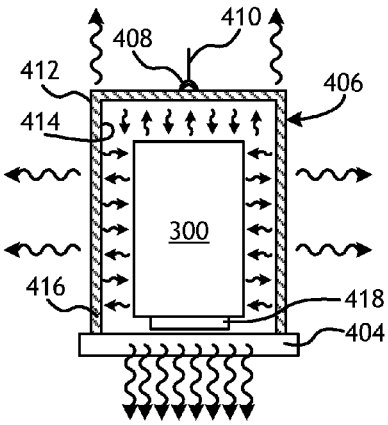

Referring now to FIGS. 4A-4C, with continued reference to FIG. 3, illustrated are schematic diagrams that sequentially illustrate an example method of heating and cooling the mold assembly 300 of FIG. 3, in accordance with the principles of the present disclosure. In FIG. 4A, the mold assembly 300 is depicted as being positioned within a furnace 402. The temperature of the mold assembly 300 and its contents are elevated within the furnace 402 until the binder material 324 liquefies and is able to infiltrate the matrix reinforcement materials 318. Once a specific location in the mold assembly 300 reaches a certain temperature in the furnace 402, or the mold assembly 300 is otherwise maintained at a particular temperature for a predetermined amount of time, the mold assembly 300 is then removed from the furnace 402 and immediately begins to lose heat by radiating thermal energy to its surroundings while heat is also convected away by cooler air outside the furnace 402. In some cases, as depicted in FIG. 4B, the mold assembly 300 may be transported to and set down upon a thermal heat sink 404.

The radiative and convective heat losses from the mold assembly 300 to the environment continue until an insulation enclosure 406 is lowered around the mold assembly 300. The insulation enclosure 406 may be a rigid shell or structure used to insulate the mold assembly 300 and thereby slow the cooling process. In some cases, the insulation enclosure 406 may include a hook 408 attached to a top surface thereof. The hook 408 may provide an attachment location, such as for a lifting member, whereby the insulation enclosure 406 may be grasped and/or otherwise attached to for transport. For instance, a chain or wire 410 may be coupled to the hook 408 to lift and move the insulation enclosure 406, as illustrated. In other cases, a mandrel or other type of manipulator (not shown) may grasp onto the hook 408 to move the insulation enclosure 406 to a desired location.

The insulation enclosure 406 may include an outer frame 412, an inner frame 414, and insulation material 416 arranged between the outer and inner frames 412, 414. In some embodiments, both the outer frame 412 and the inner frame 414 may be made of rolled steel and shaped (i.e., bent, welded, etc.) into the general shape, design, and/or configuration of the insulation enclosure 406. In other embodiments, the inner frame 414 may be a metal wire mesh that holds the insulation material 416 between the outer frame 412 and the inner frame 414. The insulation material 416 may be selected from a variety of insulative materials, such as those discussed below. In at least one embodiment, the insulation material 416 may be a ceramic fiber blanket, such as INSWOOL® or the like.

As depicted in FIG. 4C, the insulation enclosure 406 may enclose the mold assembly 300 such that thermal energy radiating from the mold assembly 300 is dramatically reduced from the top and sides of the mold assembly 300 and is instead directed substantially downward and otherwise toward/into the thermal heat sink 404 or back towards the mold assembly 300. In the illustrated embodiment, the thermal heat sink 404 is a cooling plate designed to circulate a fluid (e.g., water) at a reduced temperature relative to the mold assembly 300 (i.e., at or near ambient) to draw thermal energy from the mold assembly 300 and into the circulating fluid, and thereby reduce the temperature of the mold assembly 300. In other embodiments, however, the thermal heat sink 404 may be any type of cooling device or heat exchanger configured to encourage heat transfer from the bottom 418 of the mold assembly 300 to the thermal heat sink 404. In yet other embodiments, the thermal heat sink 404 may be any stable or rigid surface that may support the mold assembly 300, and preferably having a high thermal capacity, such as a concrete slab or flooring.

Once the insulation enclosure 406 is positioned over the mold assembly 300 and the thermal heat sink 404 is operational, the majority of the thermal energy is transferred away from the mold assembly 300 through the bottom 418 of the mold assembly 300 and into the thermal heat sink 404. This controlled cooling of the mold assembly 300 and its contents allows an operator to regulate or control the thermal profile of the mold assembly 300 to a certain extent and may result in directional solidification of the molten contents within the mold assembly 300, where axial solidification of the molten contents dominates radial solidification. Within the mold assembly 300, the face of the drill bit (i.e., the end of the drill bit that includes the cutters) may be positioned at the bottom 418 of the mold assembly 300 and otherwise adjacent the thermal heat sink 404 while the shank 106 (FIG. 1) may be positioned adjacent the top of the mold assembly 300. As a result, the drill bit 100 (FIGS. 1 and 2) may be cooled axially upward, from the cutters 118 (FIG. 1) toward the shank 106 (FIG. 1).

Such directional solidification (from the bottom up) may prove advantageous in reducing the occurrence of voids due to shrinkage porosity, cracks at the interface between the bit blank and the molten materials, and nozzle cracks. However, the insulating capability of the insulation enclosure 406 may require augmentation to produce a sufficient amount of directional cooling. According to embodiments of the present disclosure, as an alternative or in addition to using the insulation enclosure 406, the mold assembly 300 (FIG. 3) may be modified to help influence the overall thermal profile of the infiltrated downhole tool (e.g., the drill bit 100 of FIGS. 1 and 2) and facilitate a sufficient amount of directional cooling. More particularly, embodiments of the present disclosure provide a hybrid design for the mold assembly 300 that is capable of passively producing or improving directional solidification in an infiltrated downhole tool. As described in more detail below, the hybrid configurations may be applied to one or all of the components of the mold assembly 300, including the mold 302, the gauge ring 304, the funnel 306, the binder bowl 308, and the cap 310, or any other component related thereto.

Referring now to FIGS. 5A-5D, illustrated are partial cross-sectional side views of various funnels that may be used in an exemplary mold assembly, according to one or more embodiments. More particularly, FIGS. 5A-5D depict cross-sectional views of a portion of funnels 500*a*, 500*b*, 500*c*, and 500*d*, respectively. The funnels 500*a-d* may each be similar in some respects to the funnel 306 of FIG. 3 and may optionally replace the funnel 306 in the mold assembly 300 of FIG. 3. For simplicity, FIGS. 5A-5D depict cross-sectional views of only the right side of the funnels 500*a-d* while omitting the left side. It will be appreciated, however, that each funnel 500*a-d* provides a full 360° structure.

As illustrated, each funnel 500*a*-500*d* may include an inner wall 502, an outer wall 504, and a cavity 506 defined between the inner and outer walls 502, 504. The inner wall 502 may help form a portion of the infiltration chamber 312 (FIG. 3) and otherwise face the internal components and materials of the mold assembly 300 (FIG. 3). The outer wall 504, on the other hand, may form a part of the outer periphery of the mold assembly 300.

In some embodiments, the inner and outer walls 502, 504 may form an integral or monolithic structure that is hollowed out to provide or define the cavity 506 therebetween. In such embodiments, the cavity 506 may be formed by known manufacturing techniques, such as milling or turning. As an alternate example, the funnels 500*a-d* (or any of the funnels described herein) can be produced as a multi-material or hollow funnel in a multi-step process. In the first step, for instance, a blank may be formed that exhibits the shape and geometry of the cavity 506. A suitable material may be used to form the blank to either facilitate subsequent processing, such as graphite, or to provide certain thermal characteristics to promote directional solidification in the completed funnel, such as a foamed material, an insulating ceramic, a metallic shell, a conductive metallic solid, or a material that will undergo a phase change during the heating process. This blank may then be used for subsequent forming of the funnel 500*a-d*, such as by sintering or casting a ceramic or metallic material around the blank. After forming the funnel 500*a-d*, the blank material in the cavity 506 can either be removed via a suitable method (e.g., chemical etching, abrasive spray, machining out) to produce a hollow funnel or the blank material of the cavity 506 can be integrated as part of the final funnel and thereby provide key thermal properties.

Figure 5A:
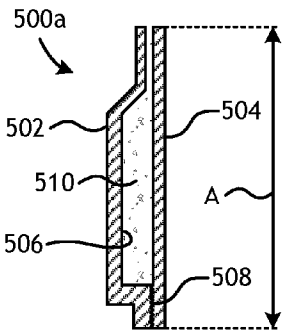
FIGS. 5A-5D are partial cross-sectional side views of various funnels that may be used in the mold assembly of FIG. 3.

In other embodiments, however, one or more of the funnels 500*a-d* may comprise a multi-component construction. In such embodiments, for instance, the inner wall 502 may be coupled to the outer wall 504 (or vice versa), such as via one or more threaded engagements 508 (FIG. 5A) or the like. As will be appreciated, a multi-component construction for the funnel 500*a-d* may prove advantageous in being able to more easily fabricate the cavity 506 to desired dimensions and/or geometries. More particularly, the inner wall 502 may be threaded to the outer wall 504 (e.g., at the threaded engagement 508 of FIG. 5A) and their combined geometry may serve to define the cavity 506. It should be noted that, while the threaded engagement 508 is depicted in FIG. 5A at a particular location on the first funnel 500*a*, suitable threaded engagements 508 may be located at any portion of the funnels 500*a-d*, without departing from the scope of the disclosure. Moreover, while not specifically depicted herein, it is contemplated to have more than one threaded engagement 508 between the inner and outer walls 502, 504 of any of the funnels 500*a-d*.

The cavity 506 may be filled at least partially with a thermal material 510. In some embodiments, the thermal material 510 may be configured to provide insulation or insulative properties to the given funnel 500*a-d*. In such embodiments, the thermal material 510 may prevent and otherwise retard heat transfer through the inner and outer walls 502, 504 and to the surrounding environment. In other embodiments, the thermal material 510 may provide or otherwise serve as a heat sink. In such embodiments, the thermal material 510 may comprise one or more materials configured to draw thermal energy from within the mold assembly 300 (FIG. 3), and thereby accelerate the cooling process of the components within the mold assembly 300.

Suitable materials for the thermal material 510 include, but are not limited to, ceramics (e.g., oxides, carbides, borides, nitrides, and silicides that may be crystalline, non-crystalline, or semi-crystalline), ceramic-fiber blankets, polymers, metals, insulating metal composites, carbon, nanocomposites, foams, fluids (e.g., air), any composite thereof, or any combination thereof. The thermal material 510 may further include, but is not limited to, materials in the form of beads, cubes, pellets, particulates, powders, flakes, fibers, wools, woven fabrics, bulked fabrics, sheets, bricks, stones, blocks, cast shapes, molded shapes, sprayed insulation, and the like, any hybrid thereof, or any combination thereof. Accordingly, examples of suitable materials that may be used as the thermal material 510 may include, but are not limited to, ceramics, ceramic fibers, ceramic fabrics, ceramic wools, ceramic beads, ceramic blocks, ceramic powders, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metals, metal powders, intermetallic powders, metal fabrics, metal foams, metal wools, metal castings, glasses, glass beads, and the like, any composite thereof, or any combination thereof.

According to embodiments of the present disclosure, the geometry and/or configuration of the funnels 500*a-d* may vary to provide varying thermal resistance or thermal properties along a height A (FIG. 5A) of the given funnel 500*a-d*. For instance, the size, the thickness, and/or the geometry of the inner and outer walls 502, 504 may vary, depending on the application, to advantageously alter the thermal properties of the given funnel 500*a-d* and thereby help control the thermal profile of the molten contents within the mold assembly 300 (FIG. 3).

Figure 5B:
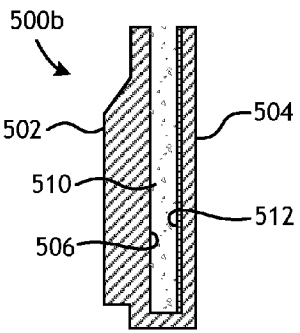
Figure 5C:
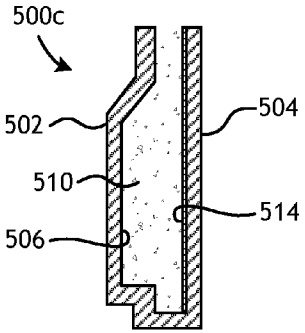

In FIG. 5A, for example, the funnel 500*a* is substantially the same size as the funnel 306 of FIG. 3, but with the cavity 506 defined therein. In FIG. 5B, however, the thickness of the inner wall 502 of the funnel 500*b* may be enlarged and extended outward (radially) to provide a substantially uniform-sized cavity 506 along the height A (FIG. 5A), which could facilitate machining of a one-piece funnel. In FIG. 5C, the size, the thickness, and/or the geometry of the inner and outer walls 502, 504 may be altered to enlarge the size of the cavity 506. In such an embodiment, the thickness of the inner and outer walls 502, 504 may be substantially the same, but could alternatively vary. It will be appreciated that the thickness of the inner and outer walls 502, 504 may vary along the height A to alter the insulating capability in certain locations, and thereby achieve specific desired thermal profiles.

Figure 5D:
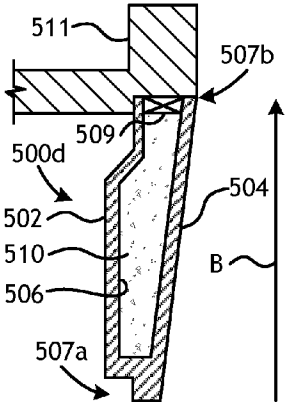

In FIG. 5D, the geometry of the funnel 500*d* is altered to provide an outward and upward taper that progressively enlarges the size of the cavity 506 from the bottom 507*a* of the funnel 500*d* to the top 507*b* of the funnel 500*d*. More particularly, the outer wall 504 of the funnel 500*d* may be angled outward with respect to the longitudinal axis of the mold assembly 300 (FIG. 3) and otherwise with respect to the inner wall 502. In embodiments where the thermal material 510 comprises an insulating material, the funnel 500*d* may therefore exhibit increased thermal resistance towards the top 507*b* of the funnel 500*d*. As a result, the funnel 500*d* allows an operator to vary the thermal resistance in the longitudinal direction B.

In some embodiments, as illustrated in FIG. 5D, the cavity 506 may be sealed or capped, such as through the use of a binder bowl 511. The binder bowl 511 may be similar in some respects to the binder bowl 308 of FIG. 3, but may exhibit thicker sidewalls as compared to the binder bowl 308. In the illustrated embodiment, the binder bowl 511 may be threaded to the funnel 500*d* to close off or seal the top of the cavity 506. In other embodiments, the cavity 506 may be sealed or capped with a plug 509 positioned within the cavity 506 at or near the top 507*b*. As will be appreciated, the binder bowl 308 and/or the plug 509 may be used to seal or cap any of the funnels 500*a-d*, without departing from the scope of the disclosure. Such embodiments may prove useful where the thermal material 510 in the cavity 506 is a gas that acts as an insulator for the mold assembly 300 (FIG. 3). Suitable gases that may be sealed within the cavity 506 include, but are not limited to, air, argon, neon, helium, krypton, xenon, oxygen, carbon dioxide, methane, nitric oxide, nitrogen, nitrous oxide, or any combination thereof.

In at least one embodiment, the cavity 506 may contain a connection to an exterior reservoir that provides heated gas to the cavity 506 to serve as a thermal energy reservoir. In this manner, a heated gas may be used to fill the cavity 506 once, or a heated gas may continuously cycle through the cavity 506 to provide a suitable thermal reservoir. In other embodiments, the gas may be omitted from the cavity 506 and a vacuum may alternatively be formed within the cavity 506 to act as an insulator. In some embodiments, the thermal material 510 may be positioned within a container (not shown) that may be filled with a gas or otherwise evacuated (i.e., a vacuum) and positioned in the cavity 506 to act as the insulator.

In some embodiments, in addition to the thermal materials 510 mentioned above or independent thereof, a reflective coating 512 (FIG. 5B) may be applied to a surface of one or both of the inner and outer walls 502, 504. While the reflective coating 512 is shown as being applied to the inner surface (i.e., within the cavity 506) of the outer wall 504, it will be appreciated that the reflective coating 512 may alternatively (or in addition thereto) be applied to the inner surface (i.e., within the cavity 506) of the inner wall 502. Moreover, the reflective coating 512 may be applied to any surface of the inner and outer walls 502, 504 of any of the funnels 500*a-d*, without departing from the scope of the disclosure.

The reflective coating 512 may be adhered to and/or sprayed onto surfaces of the inner and outer walls 502, 504 to reflect an amount of thermal energy being emitted from the molten contents within the mold assembly 300 (FIG. 3) back toward the molten contents. Suitable materials for the reflective coating 512 include a metal coating selected from group consisting of iron, chromium, copper, carbon steel, maraging steel, stainless steel, microalloyed steel, low alloy steel, molybdenum, nickel, platinum, silver, gold, tantalum, tungsten, titanium, aluminum, cobalt, rhenium, osmium, palladium, iridium, rhodium, ruthenium, manganese, niobium, vanadium, zirconium, hafnium, any derivative thereof, or any alloy based on these metals. A metal reflective coating may be applied via a suitable method, such as plating, spray deposition, chemical vapor deposition, plasma vapor deposition, etc. Alternatively, the coating material may be formed on a removable or thin substrate or as a thin member separately from the funnel 500*b* and then placed inside the funnel 500*b* to facilitate its formation. Another suitable material for the reflective coating 512 may be a paint (e.g., white for high reflectivity, black for high absorptivity), ceramic, or a metal oxide. In other embodiments, or in addition thereto, the inner surface of one or more of the inner and outer walls 502, 504 may be polished so as to increase its emissivity.

In some embodiments, in addition to the thermal materials 510 mentioned above or independent thereof, a thermal barrier 514 (FIG. 5C) may be applied to a surface of one or both of the inner and outer walls 502, 504. While the thermal barrier 514 is shown as being applied to the inner surface (i.e., within the cavity 506) of the outer wall 504 in FIG. 5C, it will be appreciated that the thermal barrier 514 may alternatively (or in addition thereto) be applied to the inner surface (i.e., within the cavity 506) of the inner wall 502. Moreover, the thermal barrier 514 may be applied to any surface of the inner and outer walls 502, 504 of any of the funnels 500*a-d*. In addition, similar to the reflective coating 512 (FIG. 5B), the thermal barrier 514 can be formed independent of the funnel 500*c* and then be placed inside the funnel 500*c* for use.

The thermal barrier 514 may provide resistance to radiation heat transfer between the thermal material 510 and the exterior of the funnels 500*a-d*. Suitable materials that may be used as the thermal barrier 514 include, but are not limited to, aluminum oxide, aluminum nitride, silicon carbide, silicon nitride, quartz, titanium carbide, titanium nitride, yttria-stabilized zirconia, borides, carbides, nitrides, and oxides. The thermal barrier 514 may be applied to surfaces of the inner and outer walls 502, 504 via a variety of processes or techniques including, but not limited to, electron beam physical vapor deposition, air plasma spray, high velocity oxygen fuel, electrostatic spray assisted vapor deposition, chemical vapor deposition, and direct vapor deposition. Accordingly, the thermal barrier 514 may advantageously lower the radiosity (e.g., radiant heat flux) and/or lower the heat transfer through to the funnels 500*a-d*, thereby helping maintain heat within the mold assembly 300

(FIG. 3) and otherwise promote its ability to redirect thermal energy back at the molten contents within the mold assembly 300.

Figure 6A:
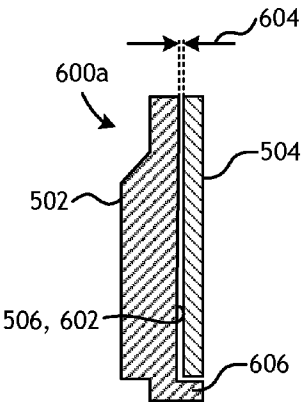
FIGS. 6A and 6B are partial cross-sectional side views of other exemplary funnels that may be used in the mold assembly of FIG. 3.
Figure 6B:
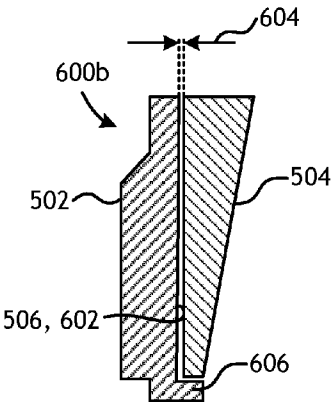

Referring now to FIGS. 6A and 6B, illustrated are partial cross-sectional side views of exemplary funnels 600*a* and 600*b*, respectively, that may be used in an exemplary mold assembly, according to one or more embodiments. Similar to the funnels 500*a-d* of FIGS. 5A-5D, the funnels 600*a,b* may each be similar in some respects to the funnel 306 of FIG. 3 and, therefore, may replace the funnel 306 in the mold assembly 300 of FIG. 3. Moreover, similar to the funnels 500*a-d* of FIGS. 5A-5D, the funnels 600*a,b* may include the inner and outer wall 502, 504, and a cavity 506 defined therebetween.

The funnels 600*a,b* may comprise a two-piece construction, where the inner and outer walls 502, 504 form generally concentric cylinders. The inner wall 502 may also provide or include a footing 606 that extends substantially horizontal from the inner wall 502. The footing 602 may be configured to receive and support the outer wall 504. As will be appreciated, however, the footing 602 may equally extend horizontally from the outer wall 504 to support the inner wall 502, without departing from the scope of the disclosure.

In some embodiments, the inner and outer walls 502, 504 may be made of or otherwise comprise the same material(s). Suitable materials for the funnels 600*a-d* (or any of the funnels described herein) and, more particularly, the inner and outer walls 502, 504, include, but are not limited to graphite, alumina ($Al_2O_3$), and other ceramic materials. Furthermore, suitable materials for the outer wall 504 include, but are not limited to metals, insulating metal composites, nanocomposites, foams, a ceramic-fiber blanket, and any combination thereof since this material is not in direct contact with the matrix drill bit during the forming process. It will be appreciated that the same types of materials may be suitable for any component of the mold assembly 300 of FIG. 3, including the mold 302, the gauge ring 304, the binder bowl 308, and the cap 310.

In other embodiments, however, the inner and outer walls 502, 504 may comprise different materials. In at least one embodiment, for instance, the inner wall 502 may be made of graphite and the outer wall 504 may be made of alumina. In such a design, the outer wall 504 may serve as an insulating component since alumina exhibits a lower thermal conductivity than graphite. As will be appreciated, the inner and outer walls 502, 504 of any of the funnels described herein can be made of the same or dissimilar materials, without departing from the scope of the disclosure.

The cavity 506 may be characterized as a gap 602 that separates the inner and outer walls 502, 504. In some cases, the gap 602 may be filled with an insulating material (not shown), such as one of the thermal materials 510 (FIGS. 5A-5D) listed above. In other embodiments, however, the gap 602 may be vacuous and otherwise left unfilled. In some embodiments, the gap 602 may provide a separation distance 604 between the inner and outer walls 502, 504. The separation distance 604 may be fairly small or miniscule in some embodiments, such as on the order of a few millimeters or less. In other embodiments, however, the distance 604 may be greater than a few millimeters, without departing from the scope of the disclosure. In embodiments where the inner and outer walls 502, 504 comprise different materials, the separation distance 604 may prove especially advantageous in accommodating thermal expansion mismatches between the different materials.

Although not shown in FIGS. 6A and 6B, in some embodiments, a cavity similar to the cavities 506 shown in FIGS. 5A-5D may be defined or otherwise provided within one or both of the inner and outer walls 502, 504. Moreover, such a cavity may have thermal material 510 (FIGS. 5A-5D) disposed therein, as generally described above.

Referring now to FIGS. 7A-7D, illustrated are partial cross-sectional side views of exemplary funnels 700*a*-700*d*, respectively, that may be used in an exemplary mold assembly, according to one or more embodiments. The funnels 700*a-d* may be similar to the funnels 500*a-d* of FIGS. 5A-5D and, therefore, may be similar in some respects to the funnel 306 of FIG. 3 and otherwise replace the funnel 306 in the mold assembly 300 of FIG. 3. As illustrated, the funnels 700*a-d* may include the inner and outer walls 502, 504 and the cavity 506 defined therebetween.

The thermal material 510 disposed in the funnels 700*a-d* may exhibit a high heat capacity such that the thermal material 510 is converted into and otherwise serves as a thermal mass or reservoir for the mold assembly 300 (FIG. 3). More particularly, whereas thermal materials 510, such as a ceramic powder, are able to provide a level of insulation for the mold assembly 300, thermal materials 510, such as metals, are able to absorb thermal energy such that a thermal reservoir may be generated by the thermal materials 510 during the furnace cycle. As a result, the rate of cooling in the center regions of the mold assembly 300 may be reduced axially. It will be appreciated, however, that the heat capacity and insulation properties of various thermal materials 510 can also be employed simultaneously if benefit to the directional cooling can be obtained in such a fashion. Accordingly, in the illustrated embodiment, the thermal material 510 may be characterized as a thermal reservoir.

In some embodiments, as illustrated, the thermal material 510 may comprise a metal, a salt, or a ceramic in the form of a plurality of cubes, pellets, particulates, flakes, and/or a powder. Generally, the thermal material 510 for the funnels 700*a-d* may be any metal, salt, or ceramic that exhibits a suitable heat capacity, thermal conductivity, melting range (liquidus and solidus), and/or latent heat of fusion to provide the maximum amount of thermal resistance at, near, above, or below the liquidus and/or the solidus temperatures of the binder material 324. Suitable metals for the thermal material 510 in the funnels 700*a-d* may include a metal similar to the binder material 324 of FIG. 3 such as, but not limited to, copper, nickel, manganese, lead, tin, cobalt, silver, phosphorous, zinc, any alloys thereof, and any mixtures of the metallic alloys. Using a thermal material 510 that is similar to the binder material 324 may prove advantageous since they will each have the same solidus and liquidus temperatures. As a result, the thermal material 510 may be able to provide latent heat to the molten contents of the mold assembly 300 (FIG. 3) at essentially the same thermal points. In some embodiments, however, the thermal materials 510 may exhibit melting ranges that are sufficiently high so that they will not melt during the infiltration process and instead serve as a thermal reservoir during the cooling process.

Alternatively, a commercially pure metal may be used as a thermal reservoir if it has suitably high melting and boiling points in addition to a suitably low thermal diffusivity. Thermal diffusivity is equal to thermal conductivity divided by the product of density and specific heat. In essence, thermal diffusivity is a measure of the ability of a material to conduct heat versus its capability to retain heat. Silver, gold, and copper have very high thermal conductivities, especially in their pure (unalloyed) forms; correspondingly, they also have high thermal diffusivities (17.4, 12.8, and 11.7 $m^2/s$, respectively). An ideal metal that could function as a suitable thermal reservoir, due to low thermal diffusivity (0.2 $m^2/s$), while also possessing suitably high melting and boiling points, is manganese, which also has a low thermal conductivity (7.8 W/m*K). Additional suitable metals that may be used as the thermal material in the funnels 700*a-d* include gadolinium, bismuth, terbium, dysprosium, cerium, samarium, scandium, erbium, and actinium (thermal diffusivity below 0.1 $m^2/s$ and thermal conductivity less than or equal to 16 W/m*K). Other suitable metals are also possible with adequately low thermal conductivities and diffusivities. Generally, suitable materials may have upper limits of thermal conductivity of 25 W/m*K, of thermal diffusivity of 0.2 m^2/s, and of boiling point of 2200° F. Due to the propensity of many of these metals to oxidize, it is preferable to incorporate the metal in an evacuated or sealed chamber in the funnel or in proximity to a gettering agent (a material that will preferentially oxidize), or to conduct the infiltration process in a controlled atmosphere (e.g., vacuum, argon, helium, hydrogen).

When subjected to the heat provided by the furnace 402 (FIG. 4A), the thermal material 510 in FIGS. 7A-7D may absorb thermal energy from the furnace 402 and, in at least one embodiment, may become molten. Upon removing the mold assembly 300 (and the associated funnel(s) 700*a-d*) from the furnace 402, the thermal material 510 may provide heat to the molten contents within the mold assembly 300, and thereby slow its cooling rate and otherwise help directional solidification. In embodiments where the thermal material 510 becomes molten, the molten thermal material 510 may progress through a phase change from a liquid state to a solid state. As the molten thermal material 510 cools and, therefore, proceeds through a phase change process (if applicable), latent heat involved with the phase change may be released from the molten thermal material 510 until the molten mass solidifies. As will be appreciated, the time required for the molten thermal material 510 to solidify may prove advantageous in providing additional time to allow thermal energy to be removed through the bottom 418 (FIGS. 4B-4C) of the mold assembly 300 via the thermal heat sink 404 (FIGS. 4B-4C), and thereby help directionally solidify the molten contents within the mold assembly 300.

Embodiments that use metal thermal materials 510 may prove advantageous in being reusable. Once the thermal materials 510 cool, they may be subjected once again to the heat of the furnace 402 (FIG. 4A) and serve the same purpose in another downhole tool infiltration application. In one or more embodiments, as shown in FIG. 7B, the thermal material 510 may be disposed within a container or vessel 702 that may be removably positioned within the cavity 506. In such embodiments, the vessel with the thermal material 510 disposed therein may be positioned within the cavity 506 during operation and removed once the internal components of the mold assembly 300 (FIG. 3) have sufficiently cooled. Accordingly, the vessel 702 may also advantageously be reusable.

In some embodiments, the thermal material 510 may be configured to provide or extract latent heat as the result of an exothermic or endothermic chemical reaction occurring within the cavity 506. In other embodiments, the thermal material 510 may provide latent heat as the result of an allotropic phase change occurring within the cavity 506. For example, some materials used as the thermal material 510, such as iron, undergo a crystal structure change [i.e., between body-centered cubic (BCC) and face-centered cubic (FCC)] while being heated or cooled through certain temperature ranges. During the transition between crystalline structures, the iron thermal material 510 may be able to provide a specific and known energy transfer for a certain amount of time.

Referring now to FIGS. 8A-8E, illustrated are partial cross-sectional side views of exemplary funnels 800*a*-800*e*, respectively, that may be used in an exemplary mold assembly, according to one or more embodiments. The funnels 800*a-e* may be similar to the funnels 500*a-d* of FIGS. 5A-5D and, therefore, may be similar in some respects to the funnel 306 of FIG. 3 and otherwise replace the funnel 306 in the mold assembly 300 of FIG. 3. As illustrated, the funnels 800*a-d* may include the inner and outer walls 502, 504, the cavity 506 defined therebetween, and the thermal material 510 disposed within the cavity 506.

As indicated above, the geometry or configuration of the funnels 800*a-d* described herein may vary to provide varying thermal resistance or thermal properties along a height A (FIG. 8A) of a given funnel 800*a-e*. In FIG. 8A, for example, the cavity 506 may be shorter (e.g., its depth is shorter) along the height A such that the thermal material 510 only alters the thermal profile of the funnel 800*a* at a particular location along the height A. The funnel 800*b* in FIG. 8B provides a cavity 506 that has a width 802 that narrows along the height A (FIG. 8A) as it proceeds from top to bottom. In certain embodiments, this narrowing can be accomplished by a triangular cross section, thereby providing a constant change in thermal properties with respect to height A. In other embodiments, however, it may be desirable to accomplish narrowing of the cavity 506 (and modulation of its thermal properties) in a custom fashion. For example, the design shown in FIG. 8B illustrates a constant thermal property midway down the cavity 506 along the height A (FIG. 8A) after which the thickness or depth (and thermal property) is reduced according to a cubic curve.

Along similar lines, the design in FIG. 8C demonstrates a cavity 506 that defines a bulbous central area that may be configured to provide a maximum amount of thermal material 510 at an intermediate location along the height A (FIG. 8A). In addition, the funnel 800*d* of FIG. 8D modulates thermal properties by providing a cavity 506 with at least one stepped inner wall that narrows along the height A (FIG. 8A) as it proceeds from top to bottom. As will be appreciated, the cavity 506 of FIG. 8D may alternatively narrow along the height A (FIG. 8A) as it proceeds from bottom to top, without departing from the scope of the disclosure. Accordingly, the funnels 800*a-d* and their corresponding cavities 506 may be designed so as to provide different amounts of thermal material 510 vertically and thereby correspondingly alter the gradient of thermal energy laterally.

In FIG. 8E, the cavity 506 forms a tortuous channel that generally follows the inner contour of the funnel 800*e* to provide thermal properties closer to the infiltrated downhole tool. As will be appreciated, when such designed channels are difficult or impossible to machine in one piece of material, the funnel 800*e* may be machined in multiple components that are attached to each other, such as via one or more threaded engagements 508 (FIG. 5A). Alternatively, the funnel 800*e* may be formed as a multi-material or hollow funnel in the multi-step process described above that includes designing and manufacturing the blank for the cavity 506 and thereafter forming the funnel 800*e* around the blank for the cavity 506.

Figure 9:
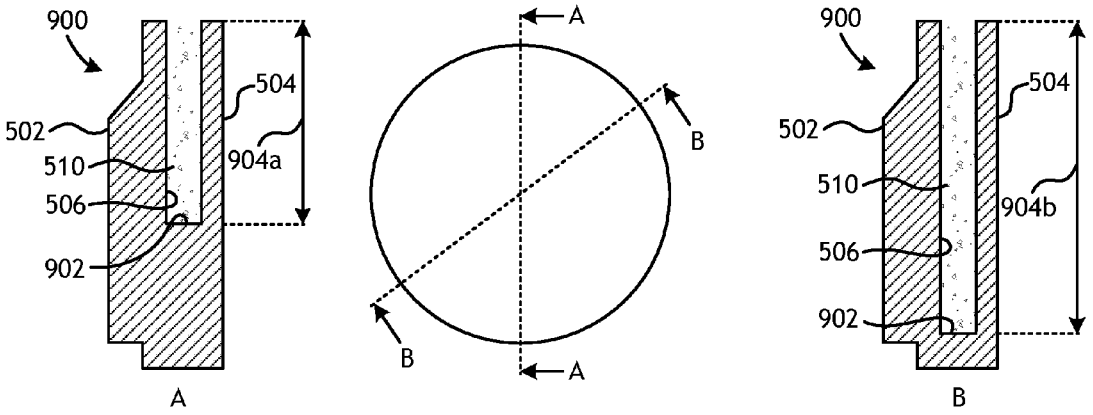
FIG. 9 depicts partial cross-sectional side views of an exemplary funnel taken at different angular locations shown in the center top view.

Referring now to FIG. 9, illustrated are partial cross-sectional side views of an exemplary funnel 900 taken at different angular locations, as shown in the center top view. The funnel 900 may be similar to or the same as any of the funnels described or shown herein. Accordingly, the funnel 900 may include the inner and outer walls 502, 504, the cavity 506 defined therebetween, and the thermal material 510 disposed within the cavity 506.

The cavity 506 in the funnel 900, however, may have an undulating or variable bottom surface 902, where the bottom surface 902 provides alternating hills and valleys (e.g., high points and low points, respectively) about the circumference of the funnel within the cavity 506. More particularly, the cavity 506 may have a first depth 904*a* at one angular location about the funnel 900, as shown along the lines A-A, but may exhibit a second depth 904*b* at a second angular location, as shown along the lines B-B. As illustrated, the first depth 904*a* is shorter than the second depth 904*b*, such that the thermal material 510 is only able to extend to the depth 904*a* in some portions of the funnel 900 while extending to the greater depth 904*b* at other portions of the funnel 900.

Those skilled in the art will readily recognize the advantage that the undulating or variable bottom surface 902 of the funnel 900 may provide. For instance, the undulating bottom surface 902 may be designed or otherwise configured to provide an operator with the ability to angularly align more or less thermal material 510 with desired locations in the infiltrated downhole tool. In some embodiments, for example, it may be desired to include increased amounts of thermal material 510 radially adjacent portions of the infiltrated downhole tool that exhibit higher thermal mass, such as the locations of the cutter blades 102 of the drill bit 100 (FIGS. 1 and 2). In such embodiments, the portions of the cavity 506 that have the second depth 904*b* may be aligned with such locations where additional thermal material 510 may be able to interact therewith. On the other hand, it may alternatively be desired to have decreased amounts of thermal material 510 radially adjacent portions of the infiltrated downhole tool that have less thermal mass, such as the locations of the junk slots 124 the drill bit 100. In such embodiments, the portions of the cavity 506 that have the first and shorter depth 904*a* may be aligned with such locations where less thermal material 510 may be deposited. As will be appreciated, such embodiments may allow an operator to focus the thermal property advantages provided by the funnel 900 in areas that are more susceptible to defects.

Figure 10:
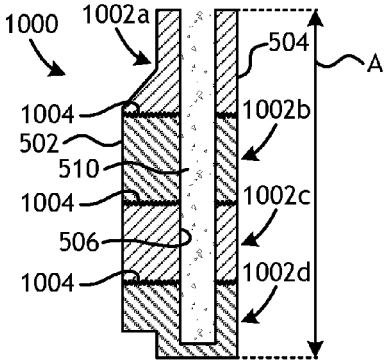
FIG. 10 is a partial cross-sectional side view of another exemplary funnel that may be used in the mold assembly of FIG. 3.

Referring to FIG. 10, illustrated is a partial cross-sectional side view of another exemplary funnel 1000 that that may be used in an exemplary mold assembly, according to one or more embodiments. The funnel 1000 may be similar to the funnels 500*a-d* of FIGS. 5A-5D and, therefore, may be similar in some respects to the funnel 306 of FIG. 3 and otherwise replace the funnel 306 in the mold assembly 300 of FIG. 3. As illustrated, the funnel 1000 may include the inner and outer walls 502, 504, the cavity 506 defined therebetween, and the thermal material 510 disposed within the cavity 506.

In the illustrated embodiment, the inner and outer walls 502, 504 may be segmented and otherwise separated axially into a plurality of rings 1002, shown as a first ring 1002*a*, a second ring 1002*b*, a third ring 1002*c*, and a fourth ring 1002*d*. While four rings 1002*a-d* are depicted in FIG. 10, it will be appreciated that more or less than four rings 1002*a-d* may be used, without departing from the scope of the disclosure. In some embodiments, as illustrated, the rings 1002*a-d* may be threaded to each other at corresponding threaded engagements 1004. In other embodiments, however, the rings 1002*a-d* may be joined via other suitable attachment or joining methods. For instance, simple attachments include locating pins with corresponding recesses, or other similar mirrored locating features/geometries, such as protrusions and channels. The rings 1002*a-d* could also be attached via a sintering or brazing process, without departing from the scope of the disclosure.

In some embodiments, the materials of the rings 1002*a-d* may be the same. In other embodiments, however, axially adjacent rings 1002*a-d* may be made of different materials that exhibit different thermal properties. In at least one embodiment, for instance, the fourth ring 1002*d* may be made of a material that has better insulation properties or exhibits a higher heat capacity (or both) as compared to the other rings 1002*a-c*. As will be appreciated by those skilled in the art, this may prove advantageous since the fourth ring 1002*d* is typically radially adjacent the metal blank 202 of the drill bit 100 (FIGS. 2 and 3) during fabrication and, more particularly, adjacent the angled surface of the metal blank 202. The angled surface of the metal blank 202 is a region that is typically sensitive to cooling rates and, therefore, more susceptible to defects. Accordingly, the funnel 1000 may be designed with rings 1002*a-d* that vary the thermal properties of the funnel 1000 along its axial height A so as to prevent or otherwise mitigate defects at or near the angled surface of the metal blank 202.

Furthermore, the thermal material 510 used in the funnel 1000 may also be composed of multiple segments (e.g., rings) as disposed within the cavity 506 in the vertical direction to provide a similar thermally graded structure. Alternatively, the cavity 506 and thermal material 510 can have different sizes in each ring segment to facilitate forming more complex internal cavities. For example, the internal wall thickness in the second and third rings 1002*b,c* could be reduced to greatly expand the width of the cavity 506 in the middle portion, similar to the design shown in FIG. 5C, thereby providing additional thermal mass in the funnel 1000.

In any of the funnel configurations and designs described herein, conductive heat transfer may be facilitated or modulated through the given funnel by using embedded refractory particles. More particularly, the material of the funnels (i.e., the material of the inner and outer walls 502, 504 of the funnels) may have refractory particles embedded therein. In some embodiments, these particles may comprise refractory ceramics. The refractory particles can be added during the forming process of the given funnel.

In any of the funnel configurations and designs described herein, a given funnel may provide or otherwise define a plurality of small, air filled cavities defined within the material of the inner and/or outer walls 502, 504. In such embodiments, the material of the given funnel could be designed using powder metallurgy techniques to contain a desired amount and size of porosity. The inner surface of the funnel (e.g., the inside surface of the inner wall 502), and potentially the outer surface 504, may be formed such that it is impermeable, such that the molten contents within the mold assembly 300 (FIG. 3) are unable to migrate into the voids formed in the funnel material. As will be appreciated, such air filled cavities may prove useful in helping to control the cooling characteristics of the given funnel. Rather than conducting the thermal energy from the molten contents within the mold assembly 300 directly through the material of the given funnel, the porous, air filled cavities and associated network provide a tortuous conduction path through the material in addition to providing slower heat flux through the pores due to radiation through entrapped air or vacuum. Also, such designs with controlled porosity can be integrated in an outer sleeve, such as the outer wall 504 in FIGS. 6A and 6B, or the thermal material 510.

In any of the funnel configurations and designs described herein, the inner and outer walls 502, 504 may be formed or created using laminated sections of the material that are bonded together using, for example, isostatic high-pressure, high-temperature molding techniques (i.e., hot isostatic pressing) or diffusion bonding techniques.

Figure 11:
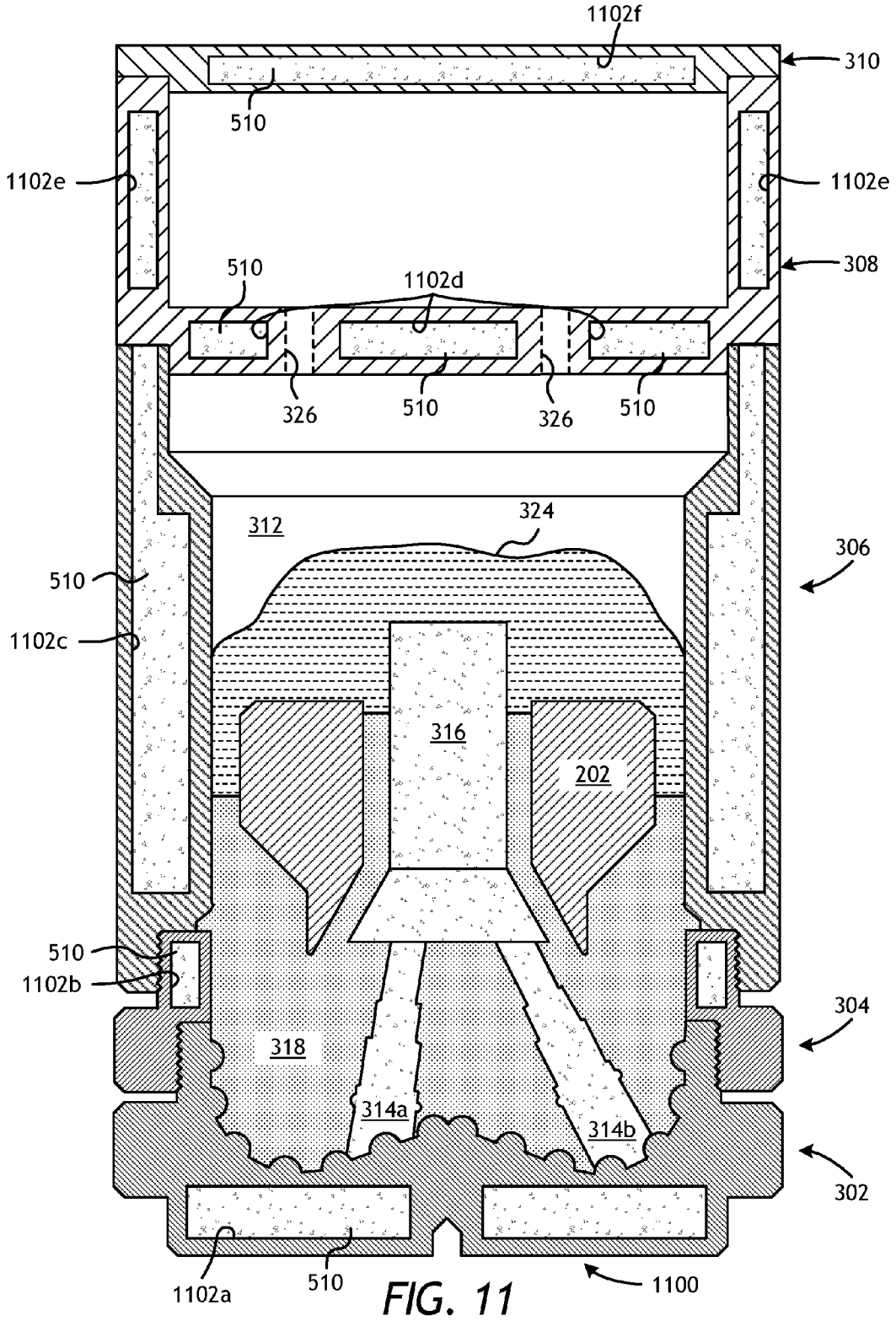
FIG. 11 is a cross-sectional side view of another exemplary mold assembly.

Referring now to FIG. 11, illustrated is a cross-sectional side view of another exemplary mold assembly 1100, according to one or more embodiments. The mold assembly 1100 may be similar to the mold assembly 300 of FIG. 3 and therefore will be best understood with reference thereto, where like numerals correspond to like elements or components that will not be described again. As illustrated, the mold assembly 1100 may include one or more of the mold 302, the gauge ring 304, the funnel 306, the binder bowl 308, and the cap 310. As indicated above, the principles of the present disclosure are not only applicable to the funnel 306 and its various configurations described herein, but are equally applicable to all components of the mold assembly 1100, without departing from the scope of the disclosure.

More particularly, one or all of the components of the mold assembly 1100 may have a cavity defined therein and filled with the thermal material 510 to alter and otherwise control the thermal properties of the mold assembly 1100. As illustrated, the mold 302 may provide a first cavity 1102*a*, the gauge ring 304 may provide a second cavity 1102*b*, the funnel 306 may provide a third cavity 1102*c*, the binder bowl 308 may provide one or more fourth cavities 1102*d*, including sidewall cavities 1102*e*, and the cap 310 may provide a fifth cavity 1102*f*. Each cavity 1102*a-f* may be filled with the thermal material 510 as described herein in any of the embodiments. In some embodiments, the size, thickness, and/or configuration of any of the cavities 1102*a-f* may be altered to meet desired thermal characteristics (i.e., thermal resistance) at predetermined locations about the mold assembly 1100. In some embodiments, for example, the height of the gauge ring 304 may be increased, thereby increasing the size of the second cavity 1102*b* and its thermal properties.

It will be appreciated that the various embodiments described and illustrated herein may be combined in any combination, in keeping within the scope of this disclosure. Indeed, variations in the size and configuration of any of the funnels described herein may be implemented in any of the embodiments, as generally described herein. Likewise, variations in the size and configuration of the funnel 306 in any of the funnels described herein may be implemented according to any of the presently described embodiments. Moreover, the different types of thermal material 510 listed or described herein may be used in any of the funnels described herein, or in any combination, without departing from the scope of the disclosure.

Embodiments disclosed herein include:

A. A mold assembly for fabricating an infiltrated downhole tool, the mold assembly including a mold forming a bottom of the mold assembly, a funnel operatively coupled to the mold and having an inner wall, an outer wall, and a cavity defined between the inner and outer walls, and an infiltration chamber defined at least partially by the mold and the funnel, wherein the inner wall faces the infiltration chamber and the outer wall forms at least a portion of an outer periphery of the mold assembly.

B. A method that includes placing a mold assembly within a furnace, the mold assembly including a mold forming a bottom of the mold assembly, a funnel operatively coupled to the mold, and an infiltration chamber defined at least partially by the mold and the funnel, wherein the funnel provides an inner wall, an outer wall, and a cavity defined between the inner and outer walls, and wherein the inner wall faces the infiltration chamber and the outer wall forms at least a portion of an outer periphery of the mold assembly removing the mold assembly from the furnace to cool molten contents disposed within the infiltration chamber, and varying a thermal profile of the molten contents with the funnel and thereby facilitating directional solidification of the molten contents.

Each of embodiments A and B may have one or more of the following additional elements in any combination: Element 1: wherein the infiltrated downhole tool is selected from the group consisting of a drill bit, a cutting tool, a non-retrievable drilling component, a drill bit body associated with casing drilling of wellbores, a drill-string stabilizer, a cone for a roller-cone drill bit, a model for forging dies used to fabricate support arms for roller-cone drill bits, an arm for a fixed reamer, an arm for an expandable reamer, an internal component associated with expandable reamers, a rotary steering tool, a logging-while-drilling tool, a measurement-while-drilling tool, a side-wall coring tool, a fishing spear, a washover tool, a rotor, a stator, a blade for a downhole turbine, and a housing for a downhole turbine. Element 2: wherein the inner wall is coupled to the outer wall. Element 3: wherein the cavity is filled at least partially with a thermal material selected from the group consisting of a ceramic, a ceramic-fiber blanket, a polymer, a metal, an insulating metal composite, a carbon, a nanocomposite, a glass, a foam, a gas, any composite thereof, and any combination thereof. Element 4: wherein the thermal material is in the form of at least one of beads, cubes, pellets, particulates, a powder, flakes, fibers, wools, a woven fabric, a bulked fabric, sheets, bricks, stones, blocks, cast shapes, molded shapes, sprayed insulation, a vacuum, any hybrid thereof, and any combination thereof. Element 5: wherein the cavity is sealed and the gas is selected from the group consisting of air, argon, neon, helium, krypton, xenon, oxygen, carbon dioxide, methane, nitric oxide, nitrogen, nitrous oxide, and any combination thereof. Element 6: wherein the thermal material is segmented into multiple rings disposed within the cavity. Element 7: wherein the funnel has a top and a bottom and a height that extends between the top and the bottom, and wherein at least one of a thickness and a geometry of one or both of the inner and outer walls varies along the height to vary a thermal property of the funnel along the height. Element 8: wherein a width of the cavity narrows along at least a portion of the height. Element 9: wherein the cavity provides a tortuous conduit along at least a portion of the height. Element 10: further comprising a reflective coating disposed within the cavity and applied to or adjacent a surface of one or both of the inner and outer walls. Element 11: further comprising a thermal barrier disposed within the cavity and applied to or adjacent a surface of one or both of the inner and outer walls. Element 12: wherein the inner and outer walls are concentric cylinders and a footing extends horizontally from the inner wall to support the outer wall. Element 13: wherein the inner and outer walls are made of different materials selected from the group consisting of graphite, alumina, a ceramic, a metal, an insulating metal composite, a nanocomposite, a foam, and a ceramic-fiber blanket. Element 14: wherein the cavity is filled at least partially with a thermal material selected from the group consisting of a metal, a salt, and a ceramic in the form of at least one of beads, cubes, pellets, particulates, a powder, and flakes, fibers, wools, a woven fabric, a bulked fabric, sheets, bricks, stones, blocks, cast shapes, molded shapes, sprayed insulation, any hybrid thereof, and any combination thereof. Element 15: wherein the thermal material is disposed within a vessel that is removably positionable within the cavity. Element 16: wherein the cavity has a bottom surface that defines alternating high points and low points about a circumference of the funnel within the cavity. Element 17: wherein the inner and outer walls are segmented axially into a plurality of rings. Element 18: wherein the plurality of rings are made of at least two dissimilar materials that exhibit different thermal properties. Element 19: further comprising at least one of a gauge ring interposing the mold and the funnel, wherein the funnel is operatively coupled to the mold via the gauge ring, a binder bowl positioned above the funnel, and a cap positionable on the binder bowl. Element 20: wherein one or more of the mold, the funnel, the gauge ring, the binder bowl, and the cap are made of a material that includes embedded refractory particles. Element 21: wherein one or more of the mold, the funnel, the gauge ring, the binder bowl, and the cap are made of a material that defines a plurality of small, air filled cavities. Element 22: wherein the cavity is a first cavity and at least one of the mold, the gauge ring, the binder bowl, and the cap defines a second cavity, and wherein the second cavity is filled at least partially with a thermal material selected from the group consisting of a ceramic, a polymer, a metal, an insulating metal composite, a carbon, a nanocomposite, a glass, a foam, a gas any composite thereof, and any combination thereof.

Element 23: wherein the cavity is filled at least partially with a thermal material, the thermal material being selected from the group consisting of a ceramic, a ceramic-fiber blanket, a polymer, a metal, an insulating metal composite, a carbon, a nanocomposite, a glass, a foam, a gas, any composite thereof, and any combination thereof, and wherein varying the thermal profile of the molten contents with the funnel comprises varying a thermal property of the mold assembly along a height of the funnel with the thermal material. Element 24: wherein the thermal material is a metal, a salt, or a ceramic in the form of at least one of beads, cubes, pellets, particulates, a powder, flakes, fibers, wools, a woven fabric, a bulked fabric, sheets, bricks, stones, blocks, cast shapes, molded shapes, sprayed insulation, any hybrid thereof, and any combination thereof, and wherein varying the thermal profile of the molten contents with the funnel comprises absorbing thermal energy with the thermal material while the mold assembly is in the furnace, and providing latent heat from the thermal material to the molten contents when the mold assembly is removed from the furnace. Element 25: wherein a reflective coating is disposed within the cavity and applied to or adjacent a surface of one or both of the inner and outer walls, the method further comprising reflecting thermal energy emitted from the molten contents back toward the molten contents with the reflective coating. Element 26: wherein a thermal barrier is disposed within the cavity and applied to or adjacent a surface of one or both of the inner and outer walls, the method further comprising increasing a thermal resistance of the funnel with the thermal barrier. Element 27: wherein the cavity is filled at least partially with a thermal material and wherein varying the thermal profile of the molten contents with the funnel comprises providing latent heat from the thermal material to the molten contents as the thermal material undergoes an exothermic chemical reaction. Element 28: wherein the cavity is filled at least partially with a thermal material and wherein varying the thermal profile of the molten contents with the funnel comprises providing latent heat as the thermal material undergoes an allotropic phase change. Element 29: wherein the mold assembly further comprises one or more of a gauge ring interposing the mold and the funnel, a binder bowl positioned above the funnel, and a cap positionable on the binder bowl, and wherein the cavity is a first cavity and at least one of the mold, the gauge ring, the binder bowl, and the cap defines a second cavity filled at least partially with a thermal material, the method further comprising varying the thermal profile of the molten contents with the thermal material disposed within the second cavity and thereby facilitating directional solidification of the molten contents.

By way of non-limiting example, exemplary combinations applicable to A, B, and C include: Element 3 with Element 4; Element 3 with Element 5; Element 3 with Element 6; Element 7 with Element 8; Element 7 with Element 9; Element 12 with Element 13; Element 14 with Element 15; Element 17 with Element 18; Element 19 with Element 20; Element 19 with Element 21; Element 19 with Element 22; and Element 23 with Element 24.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method, comprising:

placing a mold assembly within a furnace, the mold assembly including a mold forming a bottom of the mold assembly, a funnel operatively coupled to the mold, and an infiltration chamber defined at least partially by the mold and the funnel, wherein the funnel provides an inner wall, an outer wall, and a cavity defined and closed to contain a gas between the inner and outer walls, and wherein the inner wall faces the infiltration chamber and the outer wall forms at least a portion of an outer periphery of the mold assembly;

removing the mold assembly from the furnace to cool molten contents disposed within the infiltration chamber; and varying a thermal profile of the molten contents with the funnel and thereby facilitating directional solidification of the molten contents.

2. The method of claim 1, wherein the cavity is filled at least partially with a thermal material, the thermal material being selected from the group consisting of a ceramic, a ceramic-fiber blanket, a polymer, a metal, an insulating metal composite, a carbon, a nanocomposite, a glass, a foam, any composite thereof, and any combination thereof, and wherein varying the thermal profile of the molten contents with the funnel comprises varying a thermal property of the mold assembly along a height of the funnel with the thermal material.

3. The method of claim 2, wherein the thermal material is a metal, a salt, or a ceramic in the form of at least one of beads, cubes, pellets, particulates, a powder, flakes, fibers, wools, a woven fabric, a bulked fabric, sheets, bricks, stones, blocks, cast shapes, molded shapes, sprayed insulation, any hybrid thereof, and any combination thereof, and wherein varying the thermal profile of the molten contents with the funnel comprises:

absorbing thermal energy with the thermal material while the mold assembly is in the furnace; and providing latent heat from the thermal material to the molten contents when the mold assembly is removed from the furnace.

4. The method of claim 1, wherein a reflective coating is disposed within the cavity and applied to or adjacent a surface of one or both of the inner and outer walls, the method further comprising reflecting thermal energy emitted from the molten contents back toward the molten contents with the reflective coating.

5. The method of claim 1, wherein a thermal barrier is disposed within the cavity and applied to or adjacent a surface of one or both of the inner and outer walls, the method further comprising increasing a thermal resistance of the funnel with the thermal barrier.

6. The method of claim 1, wherein the cavity is filled at least partially with a thermal material and wherein varying the thermal profile of the molten contents with the funnel comprises providing latent heat from the thermal material to the molten contents as the thermal material undergoes an exothermic chemical reaction.

7. The method of claim 1, wherein the cavity is filled at least partially with a thermal material and wherein varying the thermal profile of the molten contents with the funnel comprises providing latent heat as the thermal material undergoes an allotropic phase change.

8. The method of claim 1, wherein the mold assembly further comprises one or more of a gauge ring interposing the mold and the funnel, a binder bowl positioned above the funnel, and a cap positionable on the binder bowl, and wherein the cavity is a first cavity and at least one of the mold, the gauge ring, the binder bowl, and the cap defines a second cavity filled at least partially with a thermal material, the method further comprising:

varying the thermal profile of the molten contents with the thermal material disposed within the second cavity and thereby facilitating directional solidification of the molten contents.

* * * * *